US011193636B2

(12) United States Patent
Hayman et al.

(10) Patent No.: US 11,193,636 B2
(45) Date of Patent: Dec. 7, 2021

(54) RETROFIT LED SYSTEM FOR A LIGHTING SYSTEM AND LIGHT SYSTEM

(71) Applicant: J2 Light Inc., St. Albert (CA)

(72) Inventors: Jeff Hayman, St. Albert (CA); Jeremy MacGillivray, St. Albert (CA)

( * ) Notice: Subject to any disclaimer, the term of this patent is extended or adjusted under 35 U.S.C. 154(b) by 0 days.

(21) Appl. No.: 16/022,556

(22) Filed: Jun. 28, 2018

(65) Prior Publication Data

US 2019/0003654 A1 Jan. 3, 2019

Related U.S. Application Data

(60) Provisional application No. 62/526,962, filed on Jun. 29, 2017.

(51) Int. Cl.

| | |
|---|---|
| ***F21S 8/02*** | (2006.01) |
| ***F21K 9/235*** | (2016.01) |
| ***F21S 8/04*** | (2006.01) |
| ***F21V 23/02*** | (2006.01) |
| ***F21V 23/00*** | (2015.01) |
| ***F21V 21/04*** | (2006.01) |
| *F21V 23/04* | (2006.01) |
| *F21Y 115/10* | (2016.01) |
| *H05B 45/385* | (2020.01) |

(52) U.S. Cl.

CPC ..... *F21S 8/02* (2013.01); *F21K 9/235* (2016.08); *F21S 8/04* (2013.01); *F21V 21/048* (2013.01); *F21V 23/001* (2013.01); *F21V 23/003* (2013.01); *F21V 23/02* (2013.01); *F21V 23/0471* (2013.01); *F21Y 2115/10* (2016.08); *H05B 45/385* (2020.01)

(58) Field of Classification Search

CPC .... F21S 8/02; F21S 8/04; F21K 9/235; F21V 21/048; F21V 23/001; F21V 23/003; F21V 23/02; F21V 23/0471; H05B 45/37; H05B 45/50

See application file for complete search history.

(56) References Cited

U.S. PATENT DOCUMENTS

| | | | | |
|---|---|---|---|---|
| 5,029,794 | A * | 7/1991 | Wolfe | F21V 21/04 248/343 |
| 5,074,515 | A * | 12/1991 | Carter, Jr. | F21V 21/04 248/343 |
| 7,413,156 | B1 * | 8/2008 | Cho | F21S 8/04 248/200.1 |
| 7,857,492 | B2 * | 12/2010 | Dixon | F21S 8/00 362/287 |
| 8,177,176 | B2 * | 5/2012 | Nguyen | H02G 3/045 248/200.1 |
| 10,006,613 | B2 * | 6/2018 | Oudina | F21V 21/048 |
| 2009/0244908 | A1 * | 10/2009 | Lydecker | F21V 11/06 362/354 |
| 2018/0231219 | A1 * | 8/2018 | Leung | F21V 7/10 |

* cited by examiner

*Primary Examiner* — Arman B Fallahkhair

(74) *Attorney, Agent, or Firm* — The Roy Gross Law Firm, LLC; Roy Gross

(57) ABSTRACT

A retrofit LED system for a lighting system allowing ease of replacement or installation of an LED lighting system in a grid ceiling. An adapter for providing easy installation of an LED lighting system within a room. A driver for operating directly from any standard AC voltage.

7 Claims, 24 Drawing Sheets

500

500

RETROFIT LED SYSTEM FOR A LIGHTING SYSTEM AND LIGHT SYSTEM

RELATED APPLICATIONS

This application claims the benefit of priority of U.S. Provisional Application No. 62/526,962 filed on Jun. 29, 2017 entitled RETROFIT LED SYSTEM FOR A LIGHTING SYSTEM and LIGHT SYSTEM. The contents of the above applications are all incorporated by reference as if fully set forth herein in their entirety.

FIELD OF THE INVENTION

The present invention pertains to light emitting diode (LED) lighting systems and more particularly to a retrofit LED lighting system that can be installed in an existing lighting fixture for a grid ceiling or in a new grid ceiling without an existing lighting fixture. The present invention also pertains to a light adapter and more particularly to a light adapter allowing to install an LED lighting system in a room without the need of a professional electrician. The present invention also pertains to a driver allowing to drive an LED.

BACKGROUND OF THE INVENTION

Fluorescent lighting systems have typically been used in commercial interior applications for a number of years. The use of fluorescent lighting was considered to be an improvement from past lighting systems given their low energy consumption. A drawback of fluorescent lighting systems is the fact that fluorescent lamps contain mercury and many fluorescent lamps are now considered as hazardous waste.

The advent of low power and long life LED lighting systems now make fluorescent replacement a reasonable choice. Current retrofit systems for converting existing fluorescent lighting to LED lighting require the existing fixtures to hold them in place or require fasteners to affix transition elements to the existing fixtures. These systems cannot be used as new fixtures in new ceilings. Should a space require retrofitting of old fixtures plus the addition of new fixtures, two different LED lighting systems must be used. Further, the existing systems leave remarkable gaps between transition elements and the newly installed retrofit which can be unsightly.

The need to increase lighting in certain areas is a constant need and more and more individuals wish to increase the lighting in an area with an LED lighting system. The current system to install an LED lighting system requires a professional electrician to perform work to assure the system is compliant with local regulations. Therefore, there is a need for a light adapter which can convert conventional electrical wiring to support an LED lighting system without the need for a professional electrician.

Finally, there is a need for a driver which can operate from any standard AC voltages in a country.

SUMMARY OF THE INVENTION

The present provides numerous inventions including a retrofit system for a lighting system, a light adapter and a driver circuit to power a light emitting diode (LED) for any standard AC voltages.

In a first aspect, the present disclosure provides a retrofit system for a lighting system installed in a T-bar frame comprising a LED fixture for installation in the lighting system and two support protrusions positioned on the LED fixture allowing ease of installation of the LED fixture within the lighting system. The retrofit system also has one or more lift rail for raising a lighting fixture housing with the lift rail comprising one or more insertion apertures for insertion of the support protrusions within the lift rail and one or more travel slots within the lift rail interconnected to the one or more insertion apertures allowing movement of the LED fixture within the lift rail. The lift rail also has one or more drop slots within the lift rail interconnected to the travel slot at one end allowing to fix the LED fixture within the lighting system and one or more angled slots within the lift rail interconnected to the drop slot allowing the LED fixture to be supported by the T-bar frame.

In a second aspect, the present disclosure provides a lift rail for installing an LED fixture in a lighting housing with the lift rail comprising one or more insertion apertures for insertion of support protrusions from the LED fixture within the lift rail and one or more travel slots within the lift rail interconnected to the one or more insertion apertures allowing movement of the LED fixture within the lift rail. The lift rail also has one or more drop slots within the lift rail interconnected to the travel slot at one end allowing to fix the LED fixture within the lighting system and one or more drop slots within the lift rail interconnected to the travel slot at one end allowing to fix the LED fixture within the lighting system.

In a third aspect, the present disclosure provides a light adapter for use with keyless lamp holders comprising a threaded end allowing the adapter to be positioned within the keyless lamp holder and a power conditioner allowing transmission of safe low voltage from the keyless lamp holder to a LED light fixture. The light adapter also has one or more plug-in receptacles interconnecting the power conditioner to the LED light fixture and an occupancy sensor for automatic activation and deactivation of the LED light wherein the light adapter provides power to an LED fixture.

In a fourth aspect, the present disclosure provides a driver circuit to power a light emitting diode, comprising a surge protecting means to protect the light emitting diode against power surges and a power transforming means to transform the input power for the light emitting diode wherein the driver circuit is comprised of high voltage rating components.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION OF THE INVENTION

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

Figure 1:
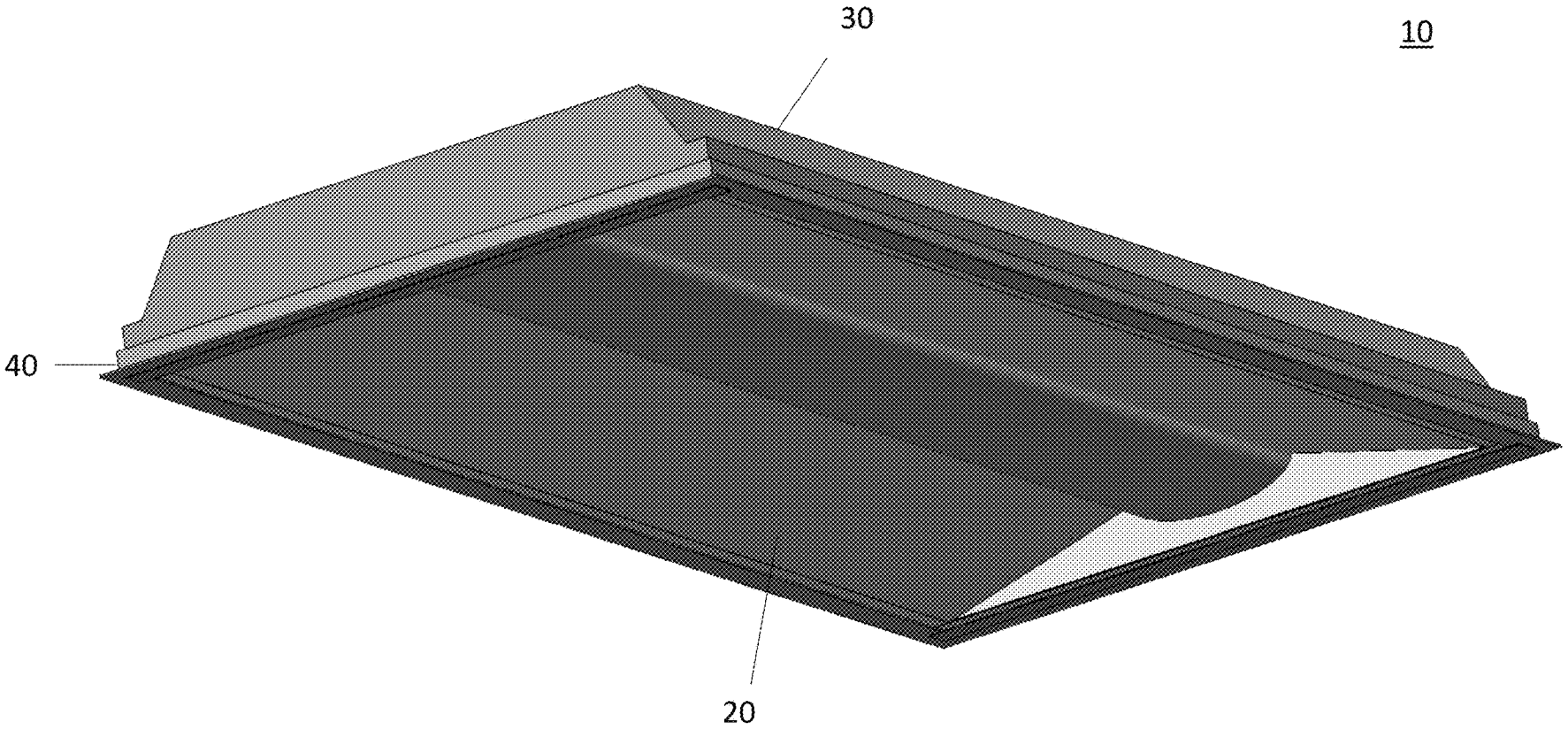
FIG. 1 is a perspective view of a retrofit LED system installed in a lighting fixture according to one embodiment of the present invention.
Figure 2:
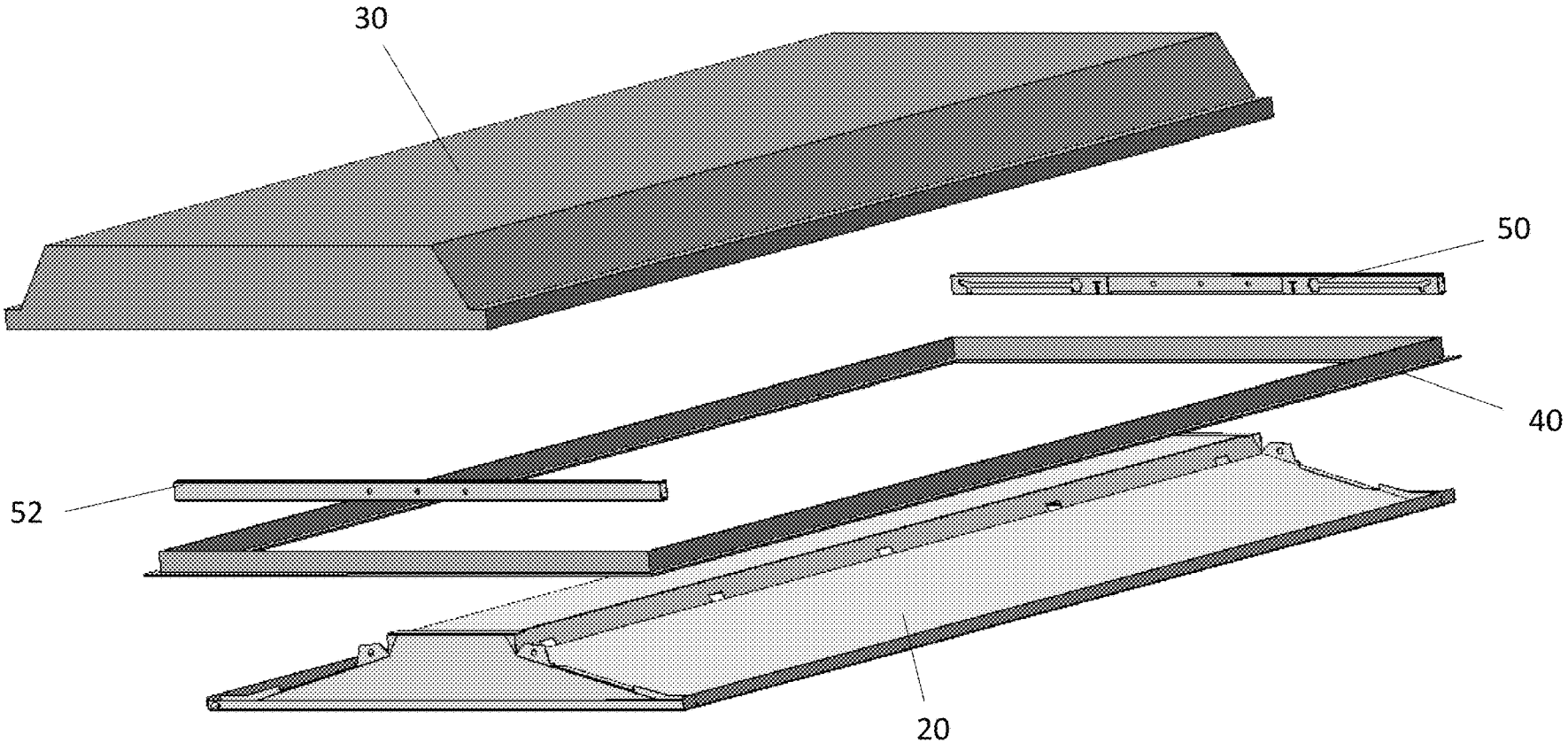
FIG. 2 is an exploded view of the various components of the retrofit LED system installed in a lighting fixture according to one embodiment of the present invention.

With reference to FIGS. 1 and 2 and according to one embodiment of the present invention, a retrofit LED lighting system 10 is shown. The system consists of an LED fixture 20 installed within an existing fixture housing 30 with a T-Bar frame 40. Lift rails 50 and 52 allow for the installation of the LED fixture 20 within the housing fixture 30 and T-Bar frame 40. T-Bar frame 40 can be for example a T-Bar frame used in a florescent lighting system which is used in commercial or large spaces. The present retrofit system can be used for replacing fluorescent lighting systems which consume a lot of energy and being replaced with more energy efficient LED lighting.

With further reference to FIG. 2 and according to one embodiment of the present invention, lift rails 50 and 52 are essential elements of the present invention since the use of the lift rails 50 and 52 allow for an easy installation of an LED fixture 20 within an existing lighting fixture 30 of a lighting system. The lift rails 50 and 52 as will be further explained below are placed within the T-Bar frame 40 allowing to raise housing fixture 30. Once lifts rails 50 and 52 are placed within the T-Bar frame 40, LED fixture 20 is positioned within lift rails 50 and 52 allowing LED fixture 20 to be subsequently secured in the T-Bar frame 40.

Figure 3:
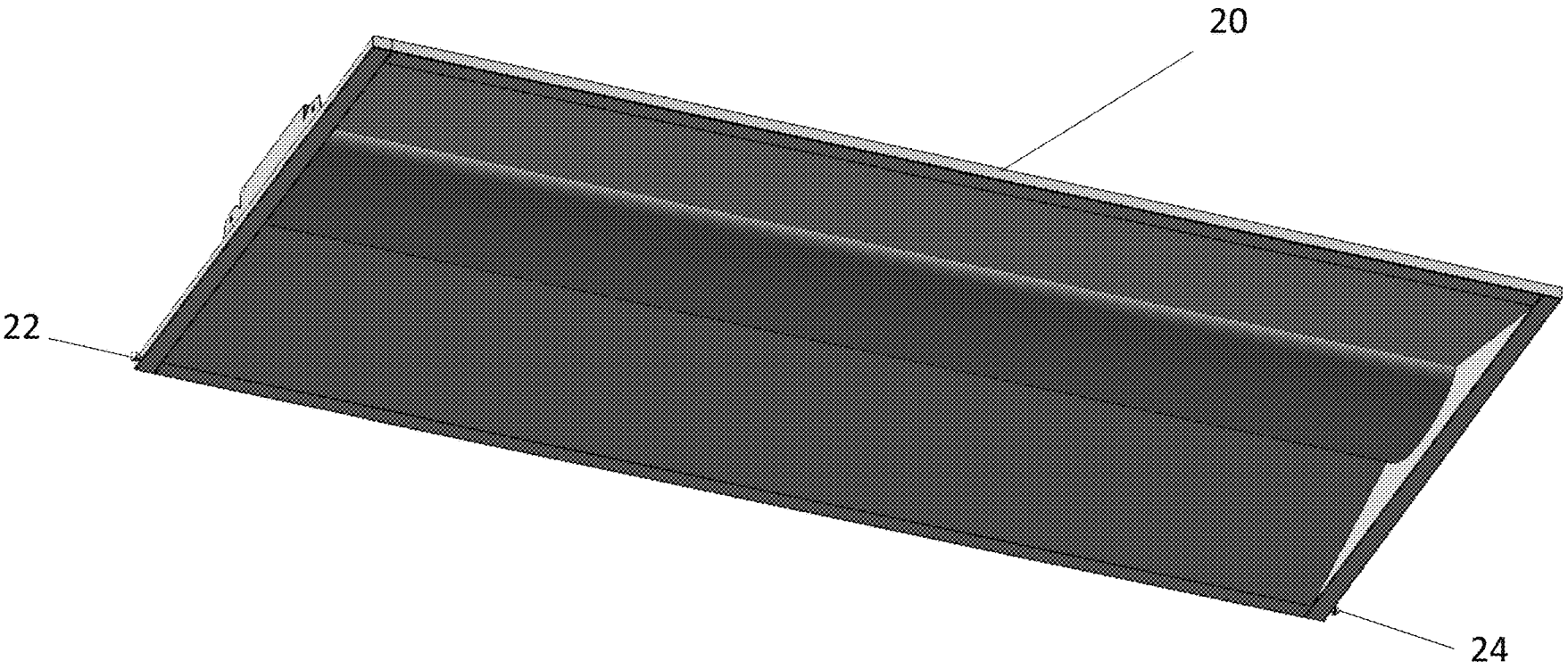
FIG. 3 is a perspective view of an LED fixture as used in the retrofit system according to one embodiment of the present invention.

With reference to FIG. 3 and according to one embodiment of the present invention, an LED fixture 20 of a retrofit system is shown. The size and shape of the LED fixture 20 is based on the T-Bar frame which will receive the retrofit system of the present invention. Two support protrusions 22 and 24 are positioned on the side walls of LED fixture 20 for interconnecting the LED fixture 20 to lift rails (not shown).

Figure 4:
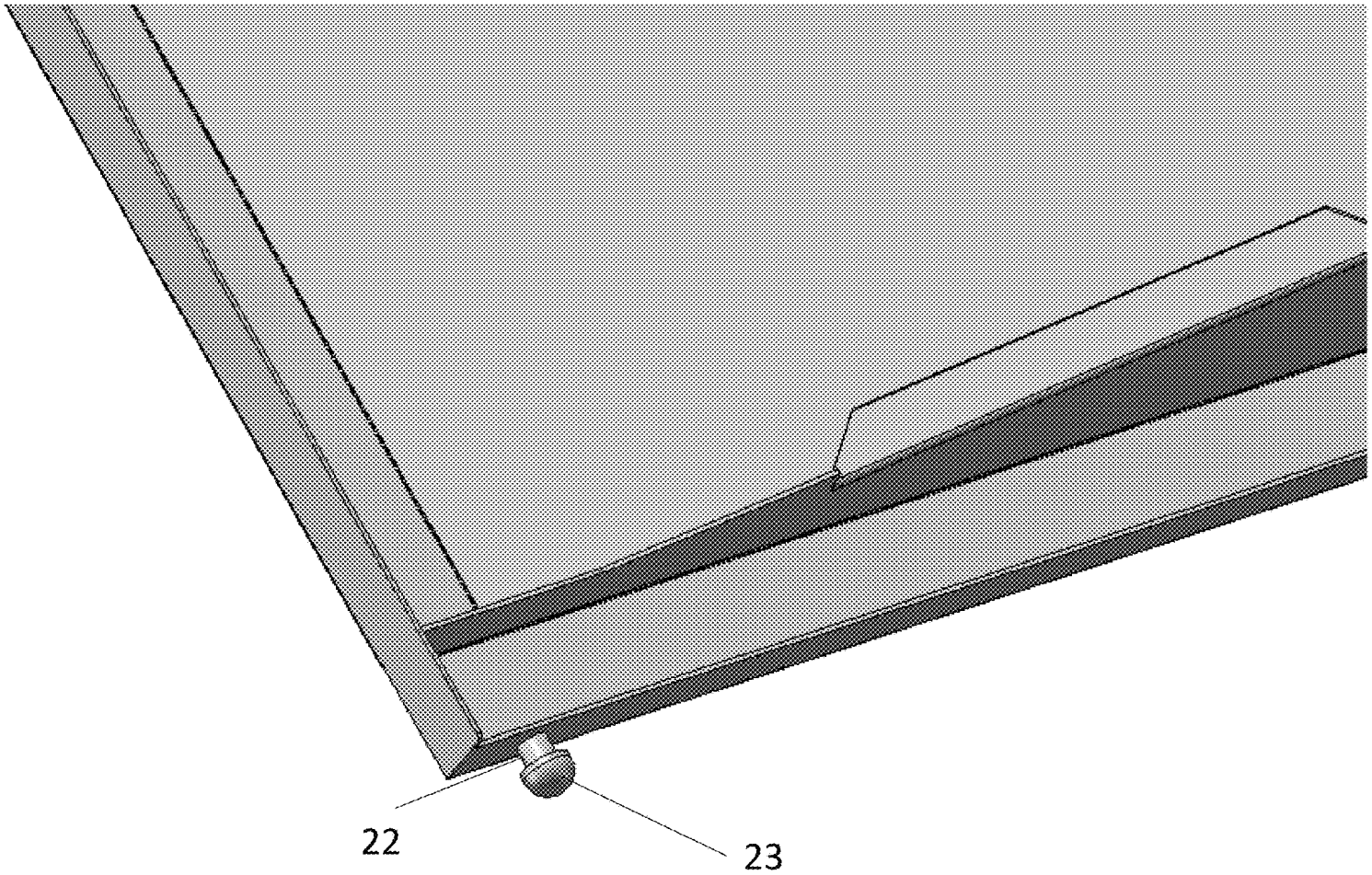
FIG. 4 is an enlarged view of a support protrusion positioned on an LED fixture according to one embodiment of the present invention.

With reference to FIG. 4 and according to one embodiment of the present invention, support protrusion 22 is shown in greater detail. Support protrusion 22 extends away from the side walls of LED fixture 20. At the tip of support protrusion 22, a male tip 23 is present to guide support protrusion 22 in a lift rail. The male tip 23 will also secure LED fixture 20 within a lift rail once installed in its final position within the retrofit system.

Figure 5:
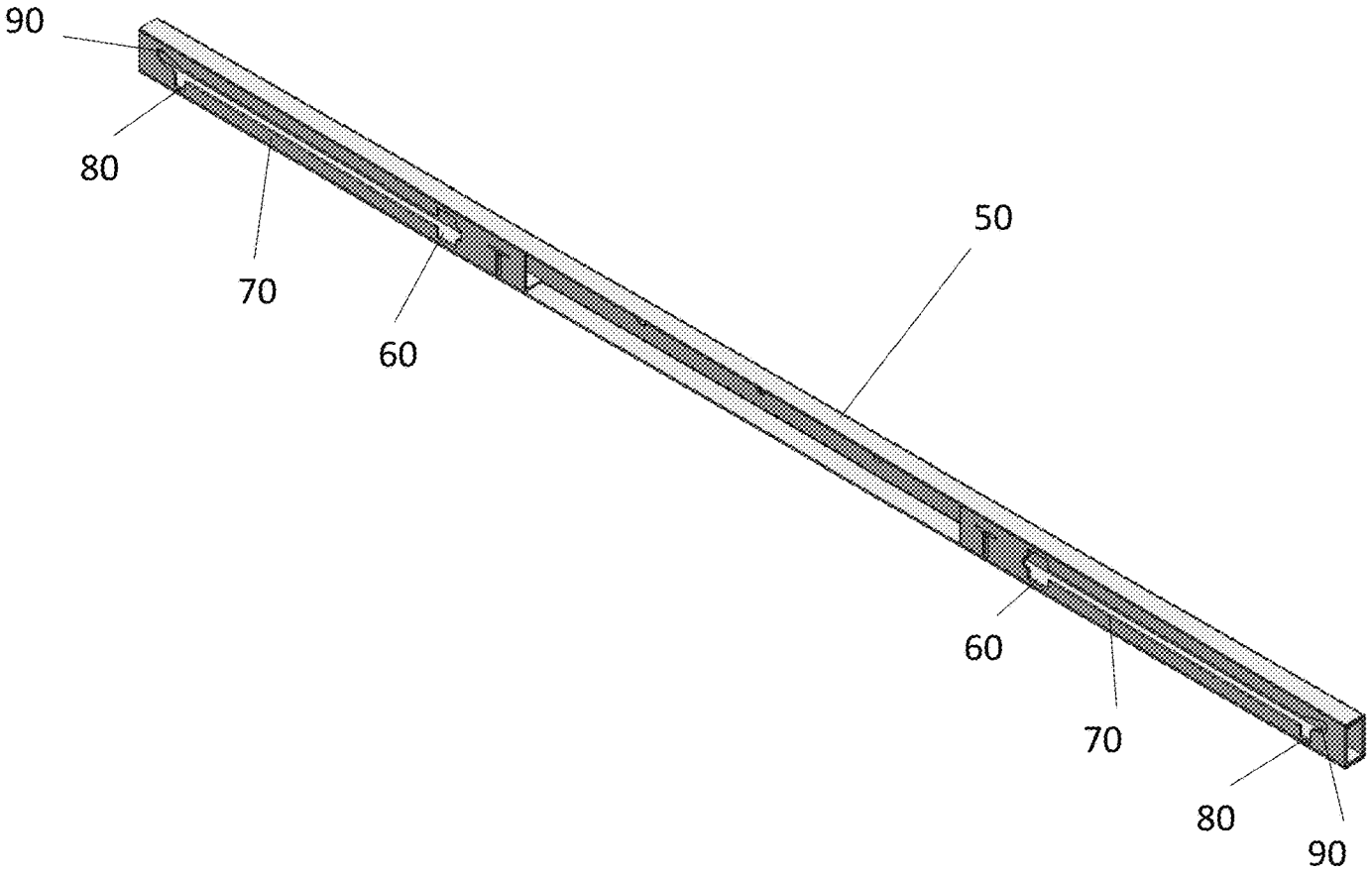
FIG. 5 is a perspective view of a lift rail used in the retrofit system according to one embodiment of the present invention.
Figure 6:
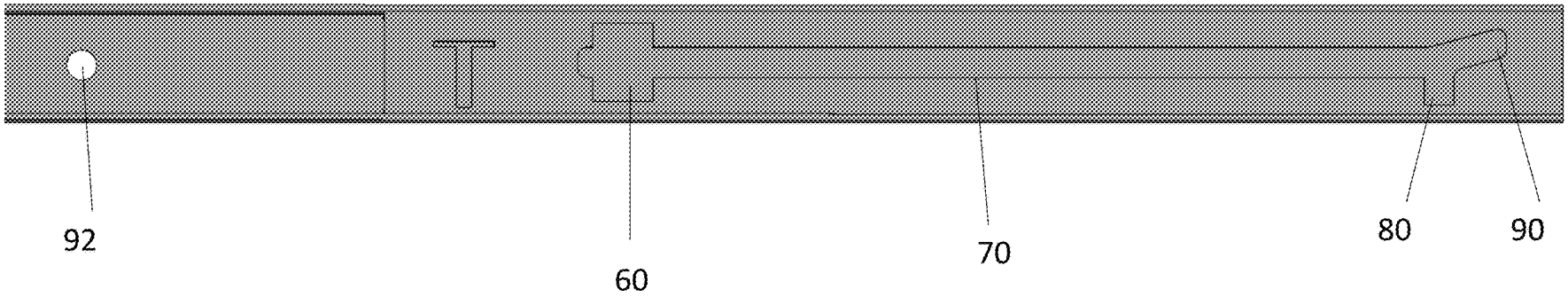
FIG. 6 is a side view of one end of a lift rail used in the retrofit system according to one embodiment of the present invention.

With reference to FIGS. 5 and 6 and according to one embodiment of the present invention, a lift rail 50 is shown. Lift rail 50 has apertures and slots along the length of lift rail 50. The slots and apertures are identical to one another at opposing ends of lift rail 50. The use of duplicate apertures and slots allows the installation of an LED fixture (not shown) at either ends of lift rail 50. Lift rail 50 has insertion apertures 60 which are the entry points for a support protrusion of an LED fixture within the lift rail 50. Travel slots 70 are connected to insertion apertures 60 allowing support protrusions from an LED fixture to travel from insertion apertures 60 into travel slots 70. Drop slots 80 are connected to travel slots 70 at the opposing end of insertion apertures 60. The drop slots 80 allow to secure an LED fixture within the T-Bar frame in its final resting position.

Angled slots 90 allow LED fixture to travel a distance permitting to clear the inner perimeter of a T-Bar frame. By allowing this movement of the LED fixture through the use of the angle slots 90, a LED fixture can then be supported by the T-Bar frame as will be further described below. Lift rail 50 also has securement apertures 92 allowing to secure lift rail 50 to a T-Bar frame through the use of screws.

Figure 7:
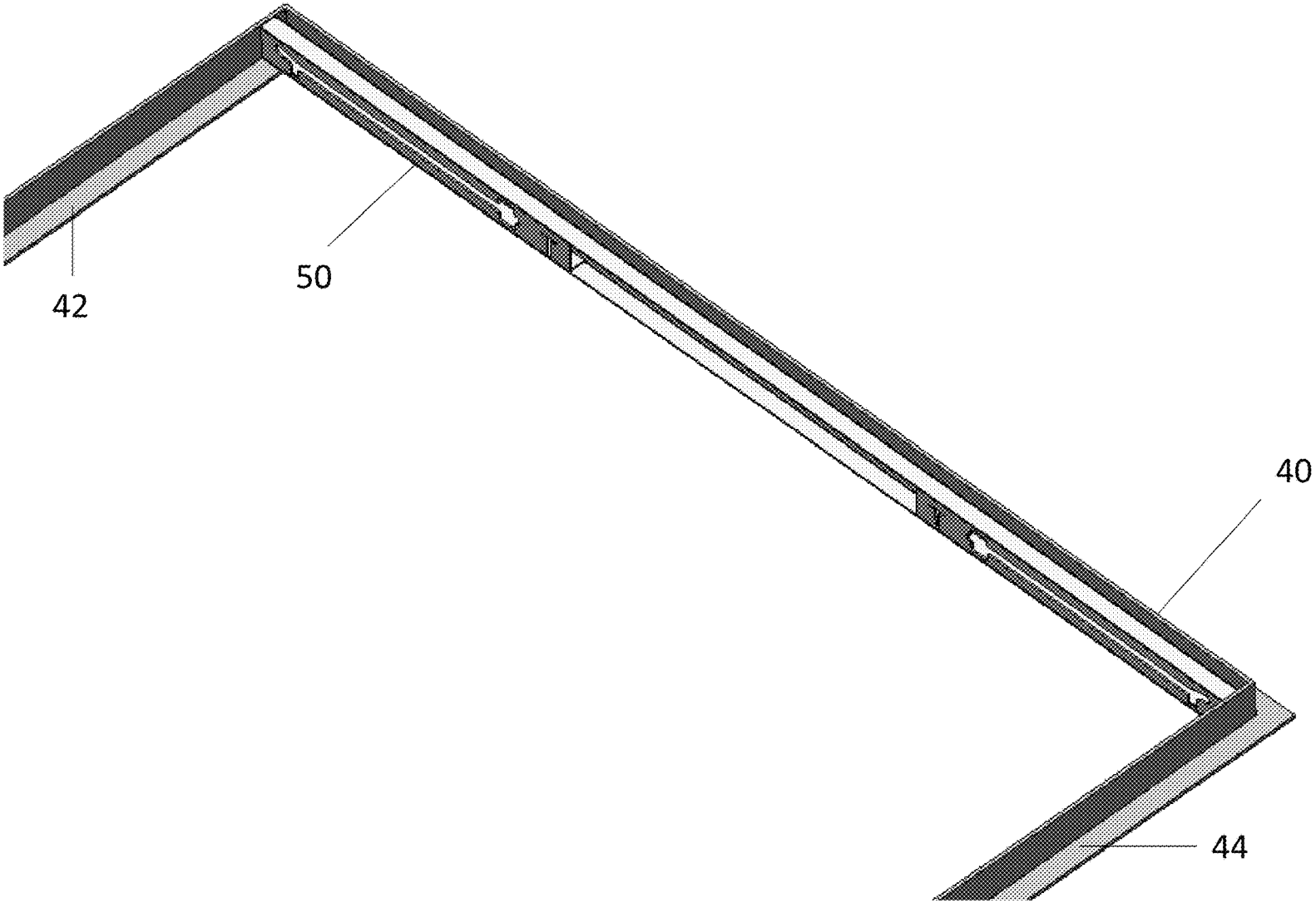
FIG. 7 is a perspective view of one end of a T-Bar frame wherein a lift rail is installed within the T-Bar frame according to one embodiment of the present invention.
Figure 8:
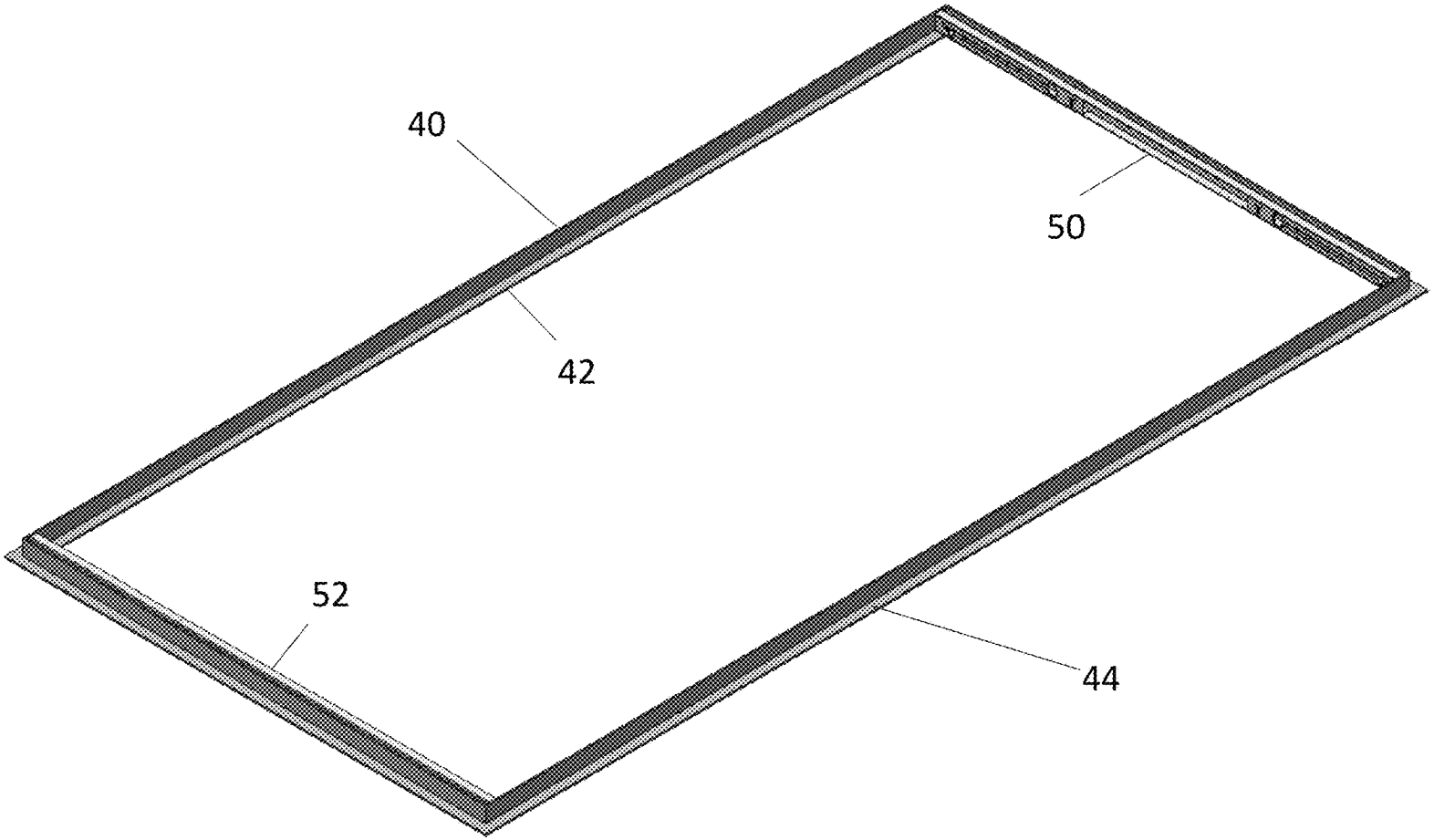
FIG. 8 is a perspective view of a T-Bar frame having two lift rails installed within the inner lip of the T-Bar frame according to one embodiment of the present invention.

With reference to FIGS. 7-17 and according to one embodiment of the present invention, the installation of a retrofit system within a T-Bar frame will be described. With specific reference to FIGS. 7-8, T-Bar frame 40 has an inner and outer lip 42 and 44 surrounding the entire edge of T-Bar frame 40. Lift rail 50 is positioned within inner lip 42 as shown in FIG. 7 with all apertures and slots of lift rail 50 facing the inner center of T-Bar Frame 40. Lift rail 52 is also positioned on inner lip 42 of T-Bar frame 40 providing opposing lift rails 50 and 52 within T-Bar frame 40.

Figure 9:
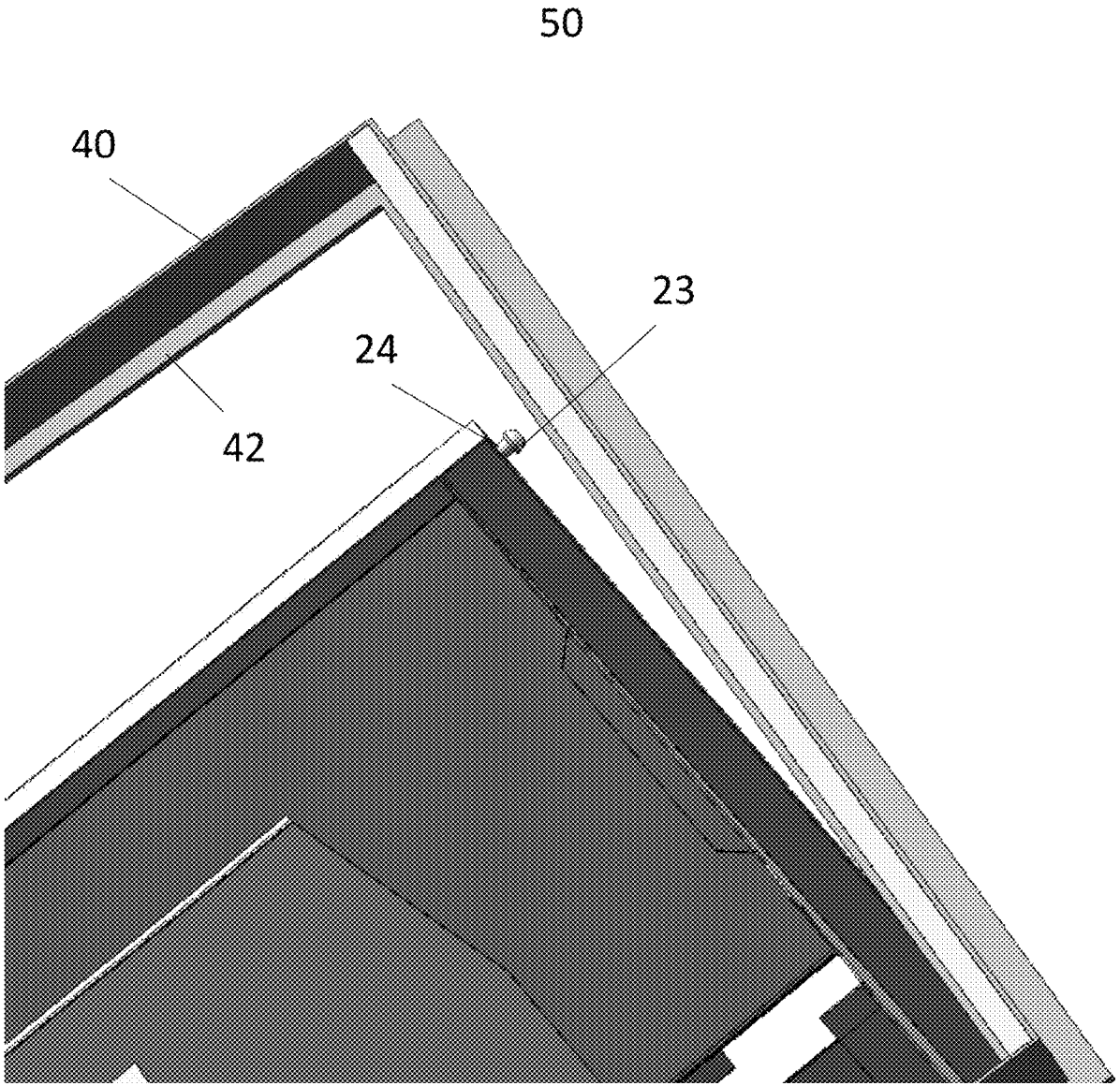
FIG. 9 is an enlarged view of an LED fixture being positioned near a lift rail according to one embodiment of the present invention.
Figure 10:
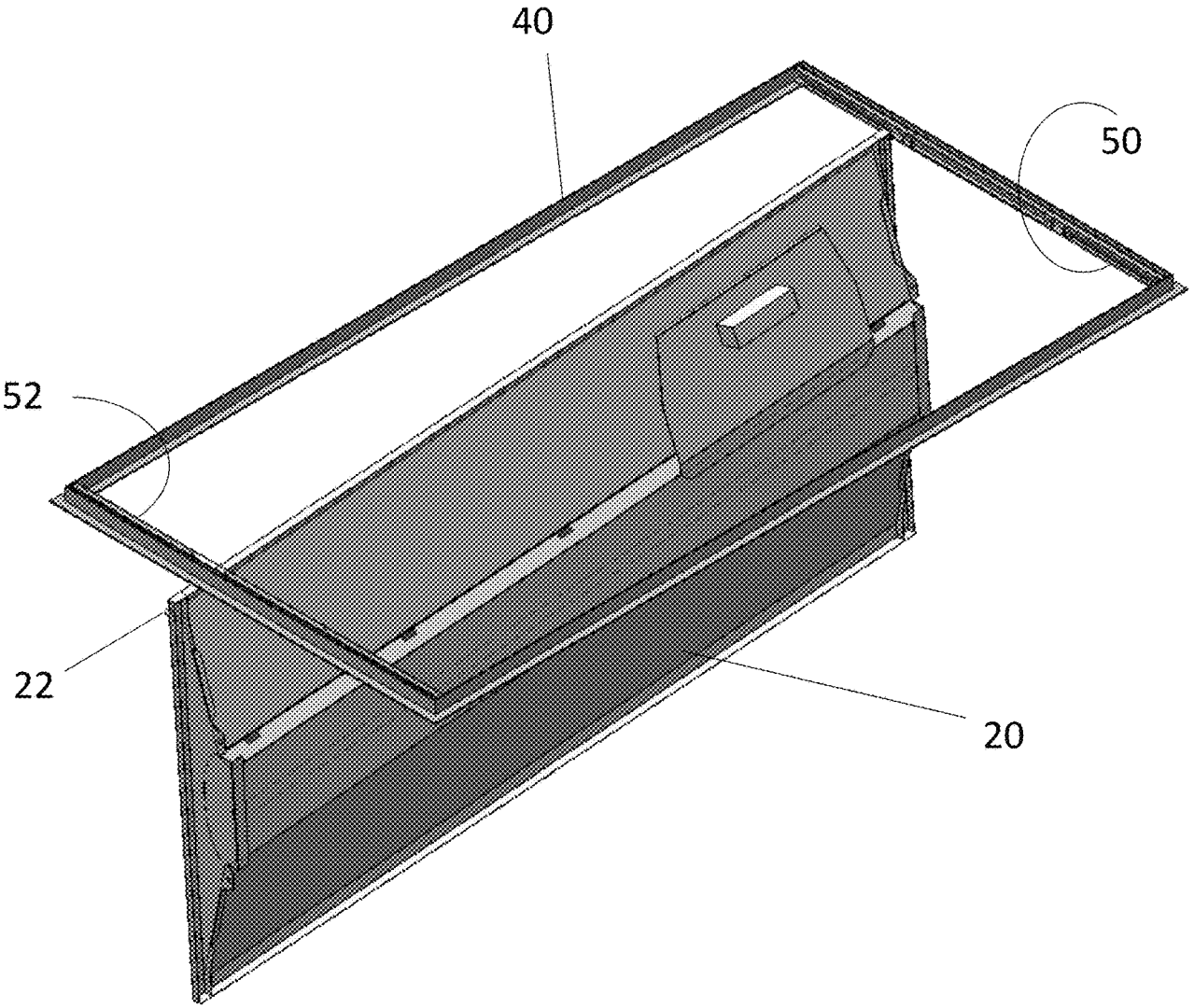
FIG. 10 is a perspective view of an LED fixture having a support protrusion positioned within a lift rail according to one embodiment of the present invention.
Figure 11:
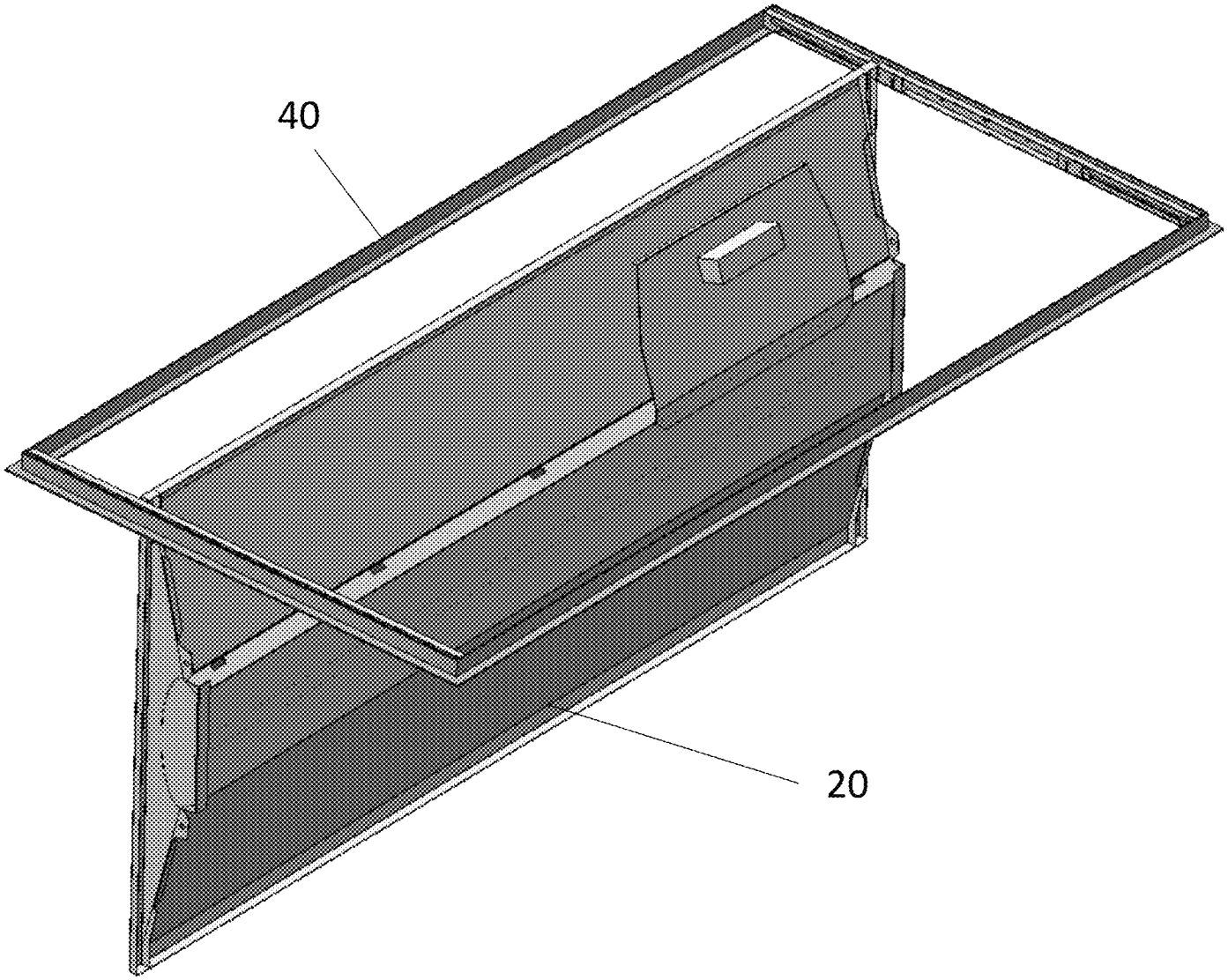
FIG. 11 is a perspective view of an LED fixture which is positioned within two lift rails allowing the LED fixture to pivot inside a T-Bar frame.
Figure 12:
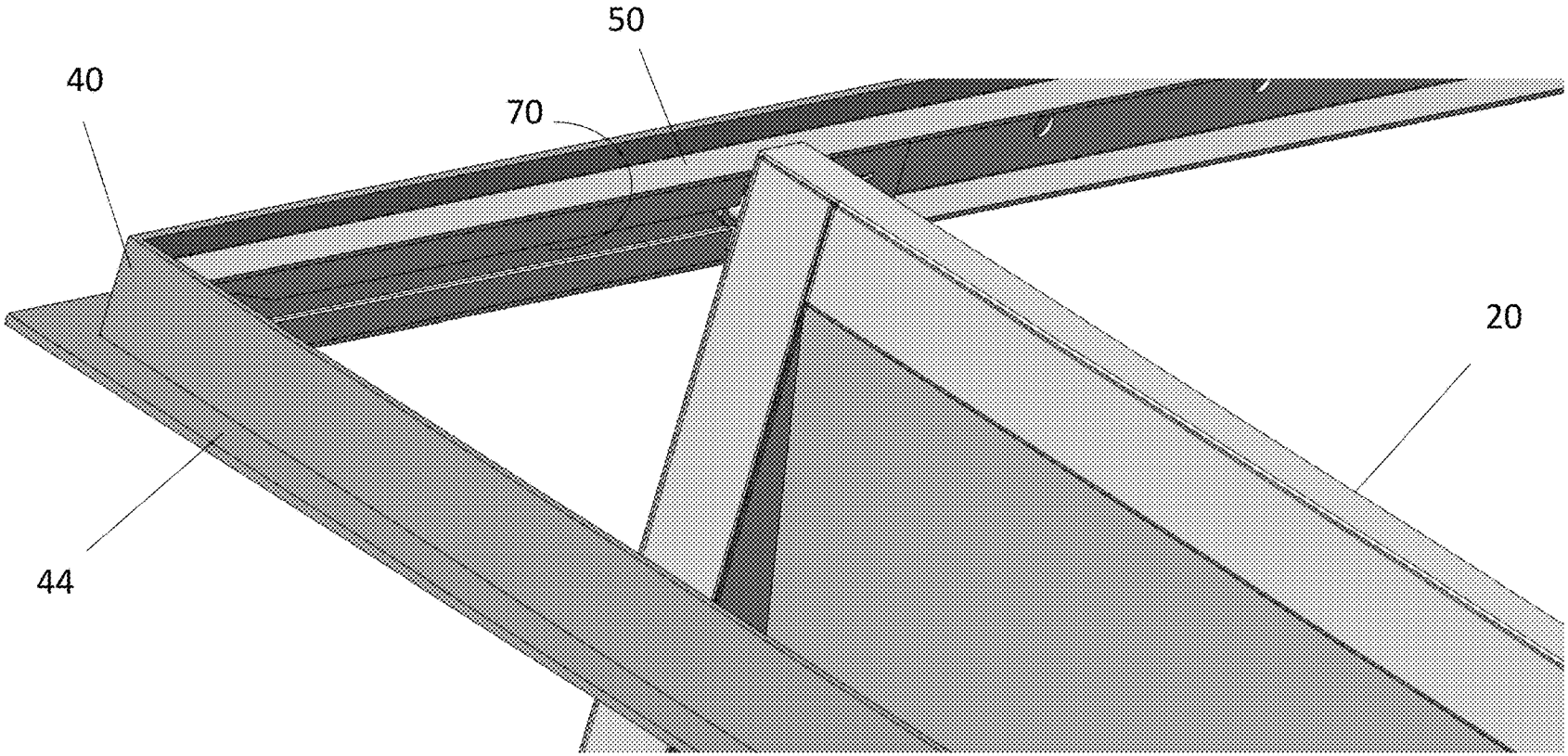
FIG. 12 is an enlarged view of a support protrusion positioned within a travel slot of a lift rail according to one embodiment of the present invention.

With specific reference to FIGS. 9-10 and according to one embodiment of the present invention, LED fixture 20 is then positioned within the inner center of T-Bar frame 40 with support protrusions directed toward the lift rails in order to have support protrusion 24 inserted within an insertion aperture of lift rail 50. LED fixture 20 is angled within T-Bar frame 40 allowing the insertion of a support protrusion within an insertion aperture. With support protrusion 24 inserted within an insertion aperture of lift rail 50, support protrusion 22 is then positioned to insert support protrusion 22 in lift rail 52. Once both protrusions 22 and 24 are positioned within lift rails 50 and 52, LED fixture 20 can then pivot from lift rails 50 and 52 positioned within T-Bar frame 40 as shown in FIG. 11.

Figure 13:
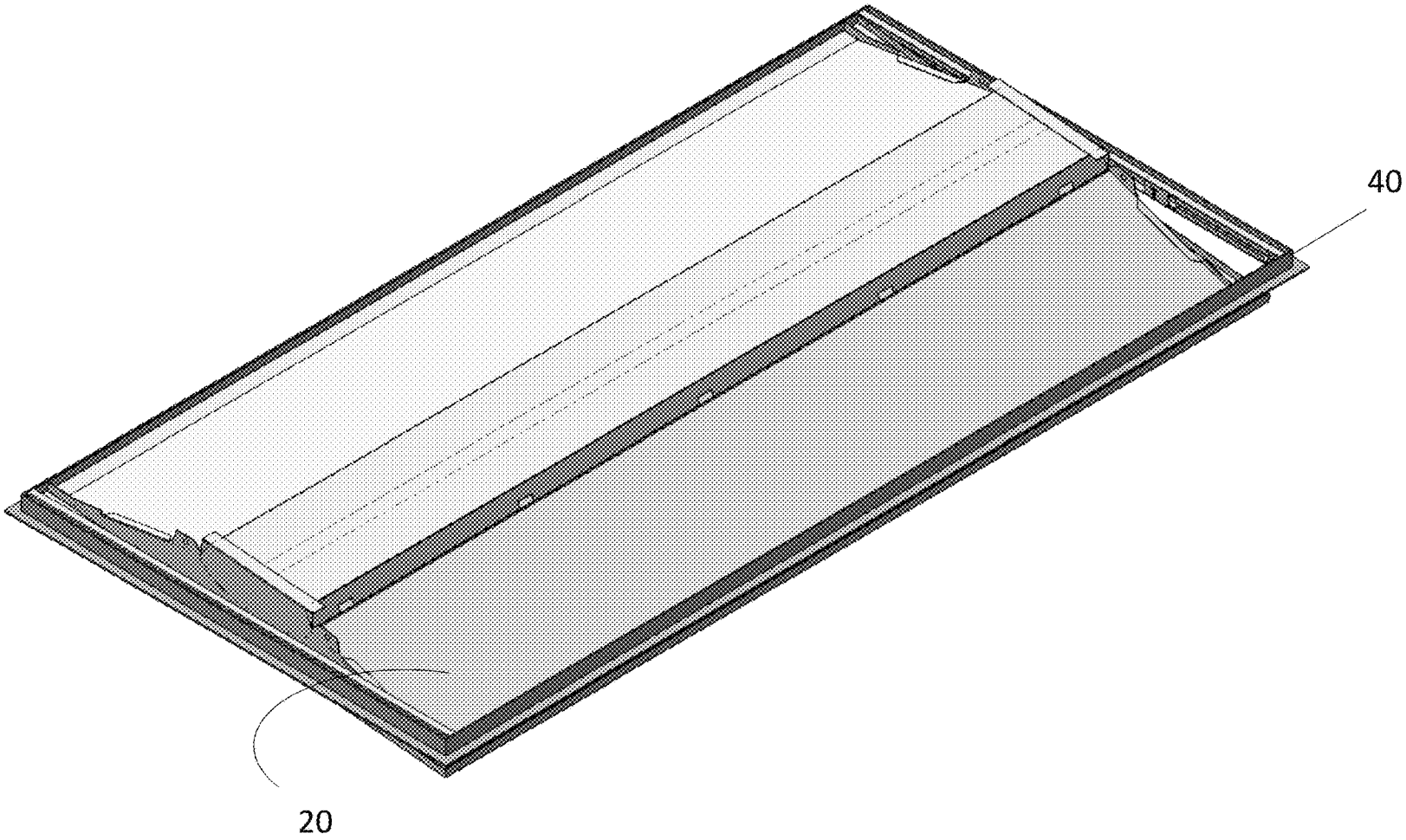
FIG. 13 is a perspective view of an LED fixture which has traveled almost the entire length of the travel slots in the lift rails according to one embodiment of the present invention.
Figure 14:
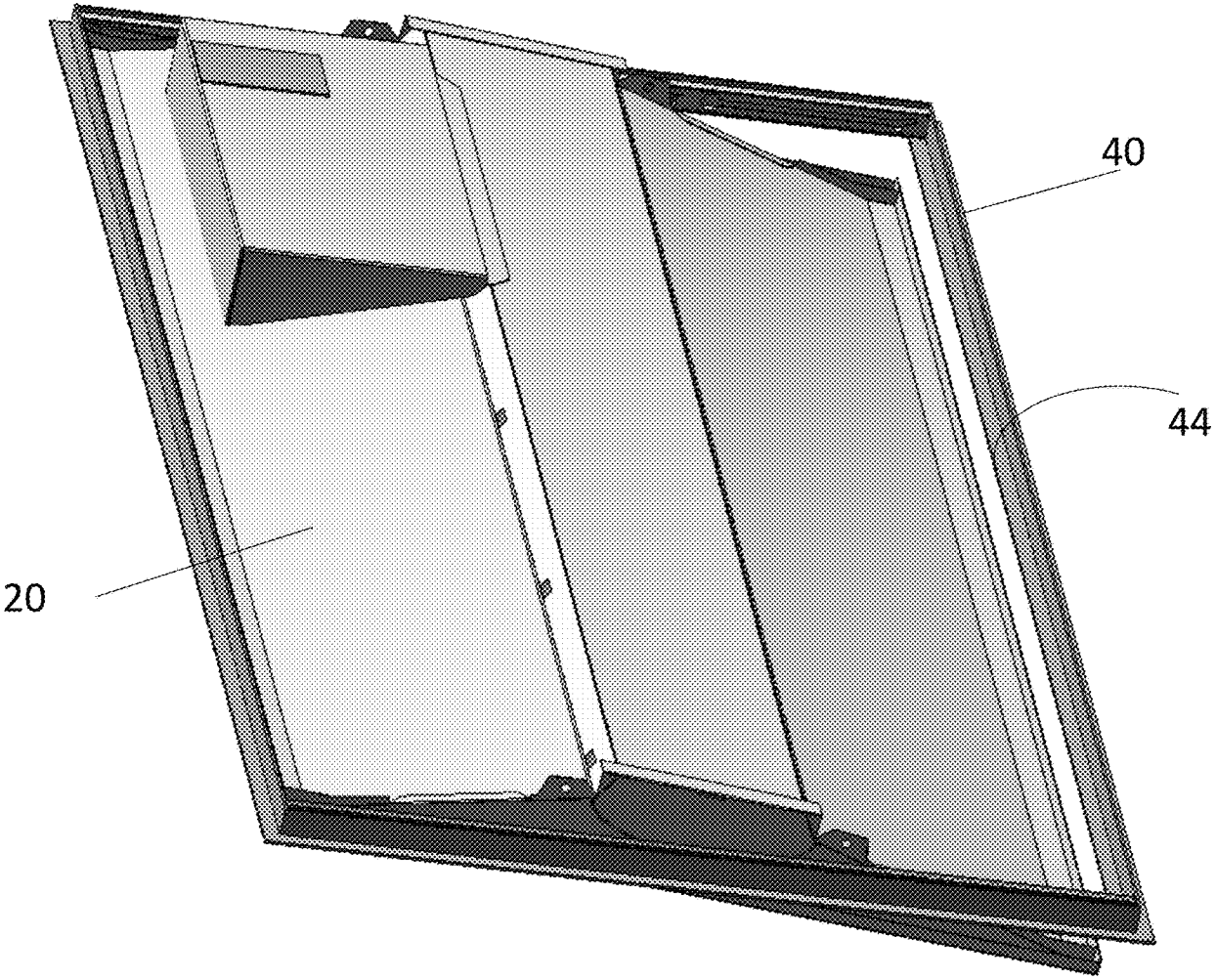
FIG. 14 is a perspective view of an LED fixture which needs to clear the inner lip of a T-Bar frame according to one embodiment of the present invention.
Figure 15:
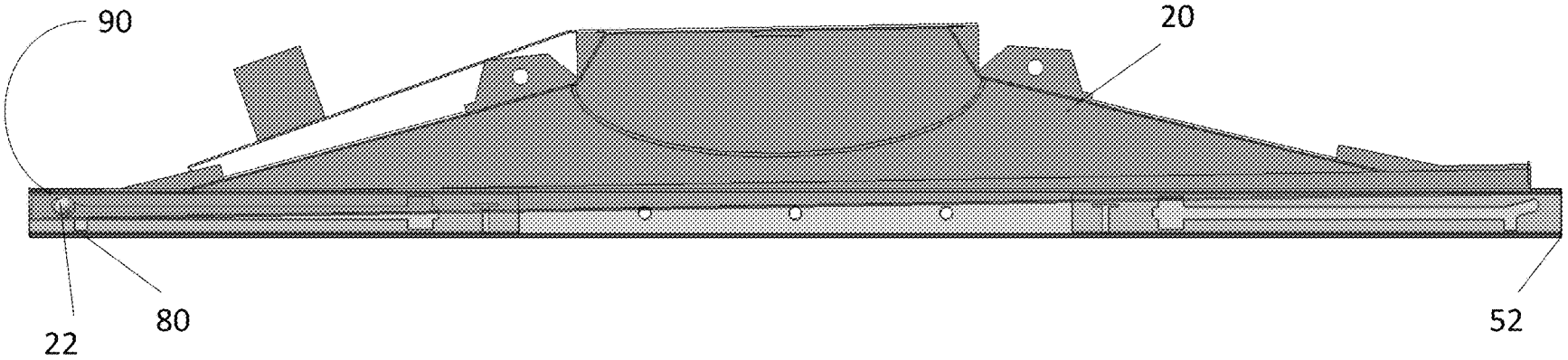
FIG. 15 is a side view of an LED fixture positioned within an angled slot allowing the Led fixture to clear the inner lip of a T-Bar frame according to one embodiment of the present invention.

With specific reference to FIGS. 13-15 and according to one embodiment of the present invention, once LED fixture 20 is suspended within lift rails 50 and 52, support protrusions 22 and 24 travel within travel slots 70 of lift rails 50 and 52 allowing to displace LED fixture almost entirely within T-Bar frame 40. For final installation of LED fixture 20 within T-Bar frame 40, LED fixture 20 must clear the inner lip 44 of T-Bar frame 40 which is achieved by moving LED fixture 20 through to angle slots 90 pass drop slots 80. By moving support protrusions 22 and 24 of LED fixture 20 within angle slots 90, LED fixture 20 will clear inner lip 44 of T-Bar frame 40 since LED fixture 20 will travel upwards and away from T-Bar frame 40 allowing LED fixture 20 to clear the inner lip 44 of T-Bar frame 40 as shown in FIG. 15.

Figure 16:
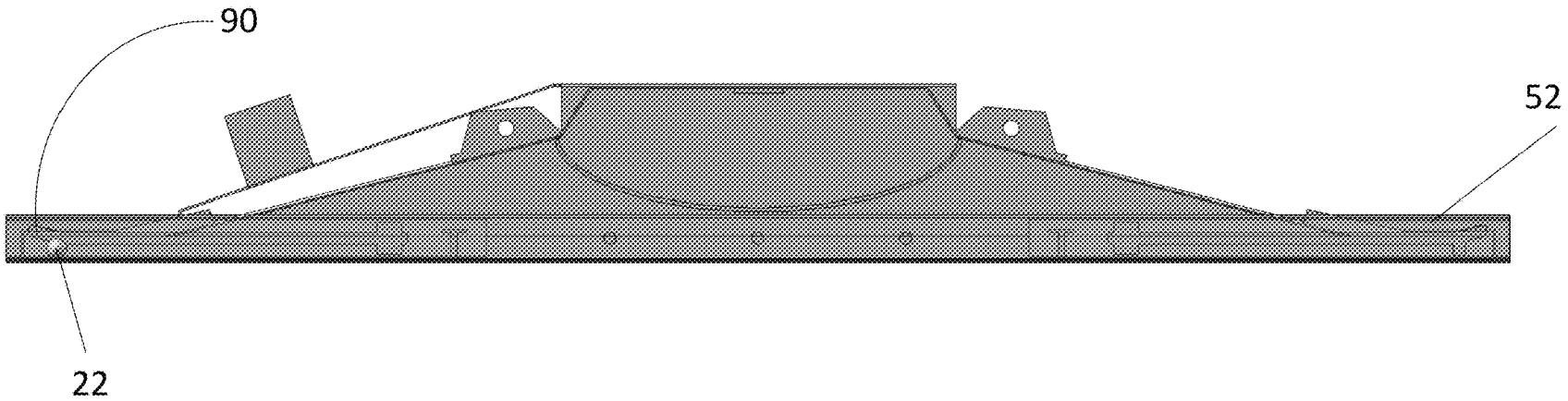
FIG. 16 is a side view of an LED fixture being positioned in the drop slot of a lift rail according to one embodiment of the present invention.
Figure 17:
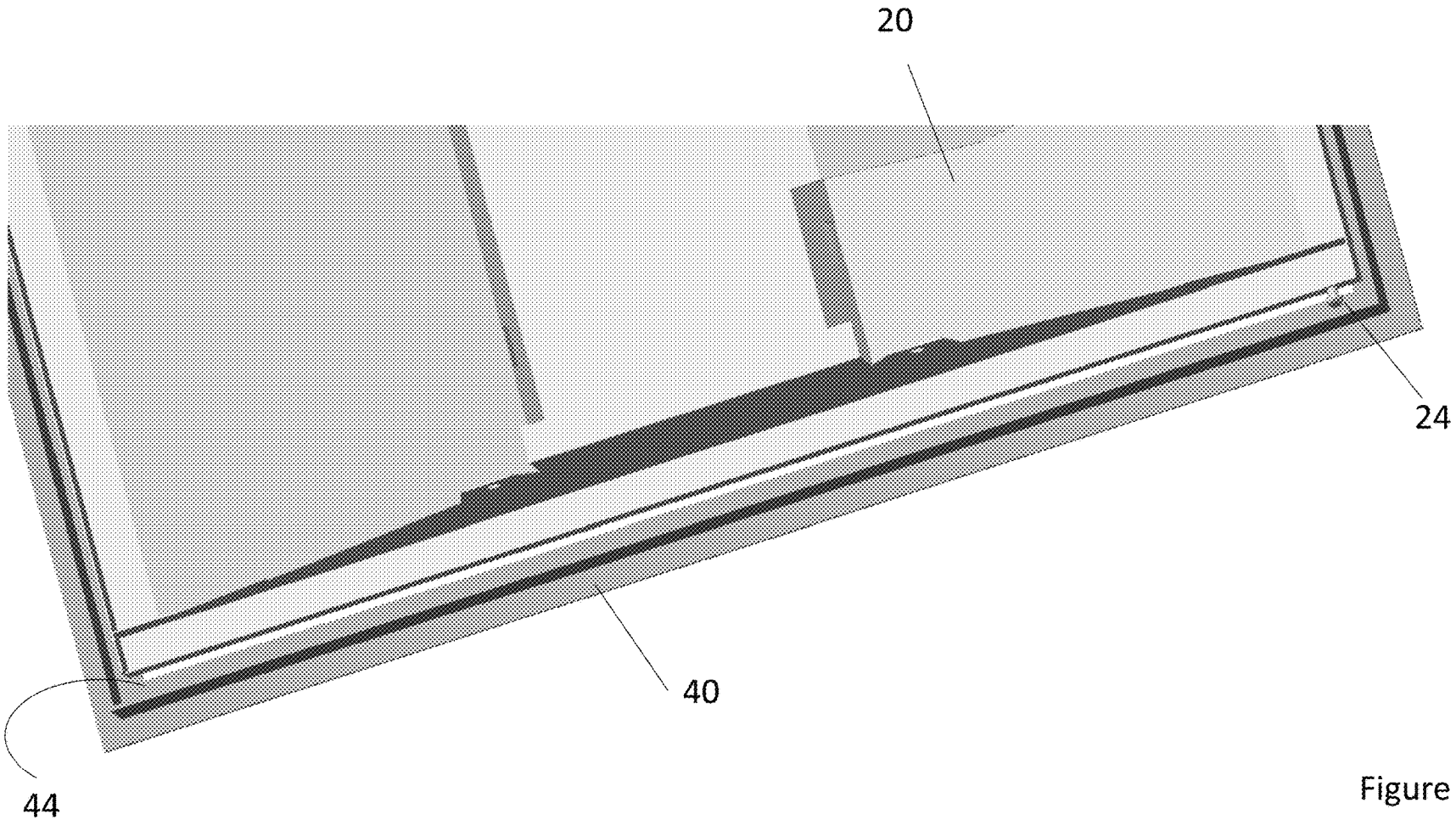
FIG. 17 is an enlarged view of an LED fixture set within a T-Bar frame with the lift rails removed to display the LED fixture resting on the inner lip of a T-Bar frame according to one embodiment of the present invention.

With specific reference to FIG. 16 and according to one embodiment of the present invention, Once LED fixture 20 has cleared inner lip 44 of T-Bar frame 40, support protrusions 22 and 24 can then be moved within drop slots 80 which will secure LED fixture 20 within T-Bar frame 40. With reference to FIG. 17, LED fixture 20 is shown resting on the inner lip of T-Bar Frame 40 wherein lift rails 50 has been removed to provide a clear view of LED fixture 20 resting on the inner lip of T-BAR frame 40. Support protrusions 24 would be within a drop slot of a lift rail of the lift rail was present.

Figure 18:
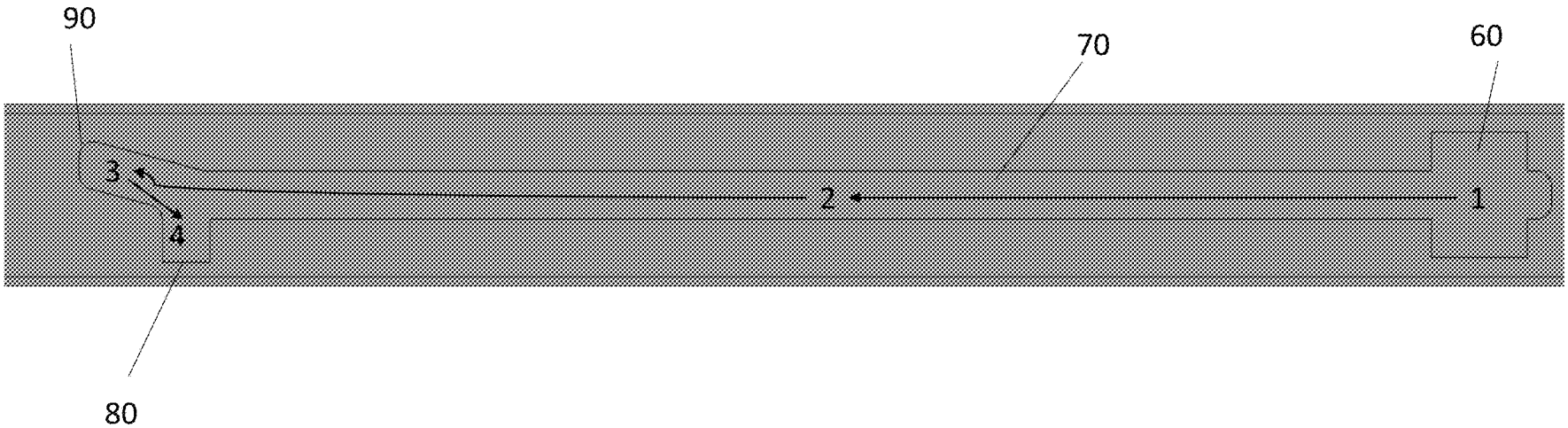
FIG. 18 is a side end view of a lift rail showing the movement sequence of a support protrusion for installing an LED fixture within a lighting fixture.

With reference to FIG. 18 and according to one embodiment of the present invention, the sequence of movement of a support protrusion through a lift rail is shown. The sequence is described for a single support protrusion, however, for an LED fixture to be installed within the present retrofit system, two opposite support protrusions such as protrusions 22 and 24 described above need to follow this sequence at the same time. The first step (STEP 1) of the sequence requires a support protrusion to be inserted in the insertion aperture 60 of a lift rail. The second step (STEP 2) has a support protrusion travel in travel slot 70 which will move a LED fixture towards a far edge of a lift rail. The third step (STEP 3) consist of moving a support protrusion pass drop slot 80 and into angle slot 90 until it reaches the end of travel slot 70 which will incline a LED fixture to clear the inner lip of a T-Bar frame. The final step (STEP 4) is to move a support protrusion into drop slot 80 which will secure a LED fixture within a T-Bar frame. The arrows in FIG. 18 illustrate the above described movements.

In another embodiment of the present invention, the retrofit system can be installed within a T-bar frame without the need for a housing fixture. The LED lighting fixture of the present retrofit system can be operational without the need of the housing fixture. The housing fixture is not an essential element of the retrofit system since the LED fixture is designed to be operational and installed with or without a housing fixture in conjunction with the lift rails.

The term T-Bar frame is interchangeable with the term grid ceiling as would be known by a worker skilled in the relevant art.

The term LED fixture encompasses all of the elements that are required to provide a functional LED fixture as would be known by a worker skilled in the relevant art.

A person understanding this invention may now conceive of alternative structures and embodiments or variations of the above all of which are intended to fall within the scope of the invention as defined in the claims that follow.

Figure 19:
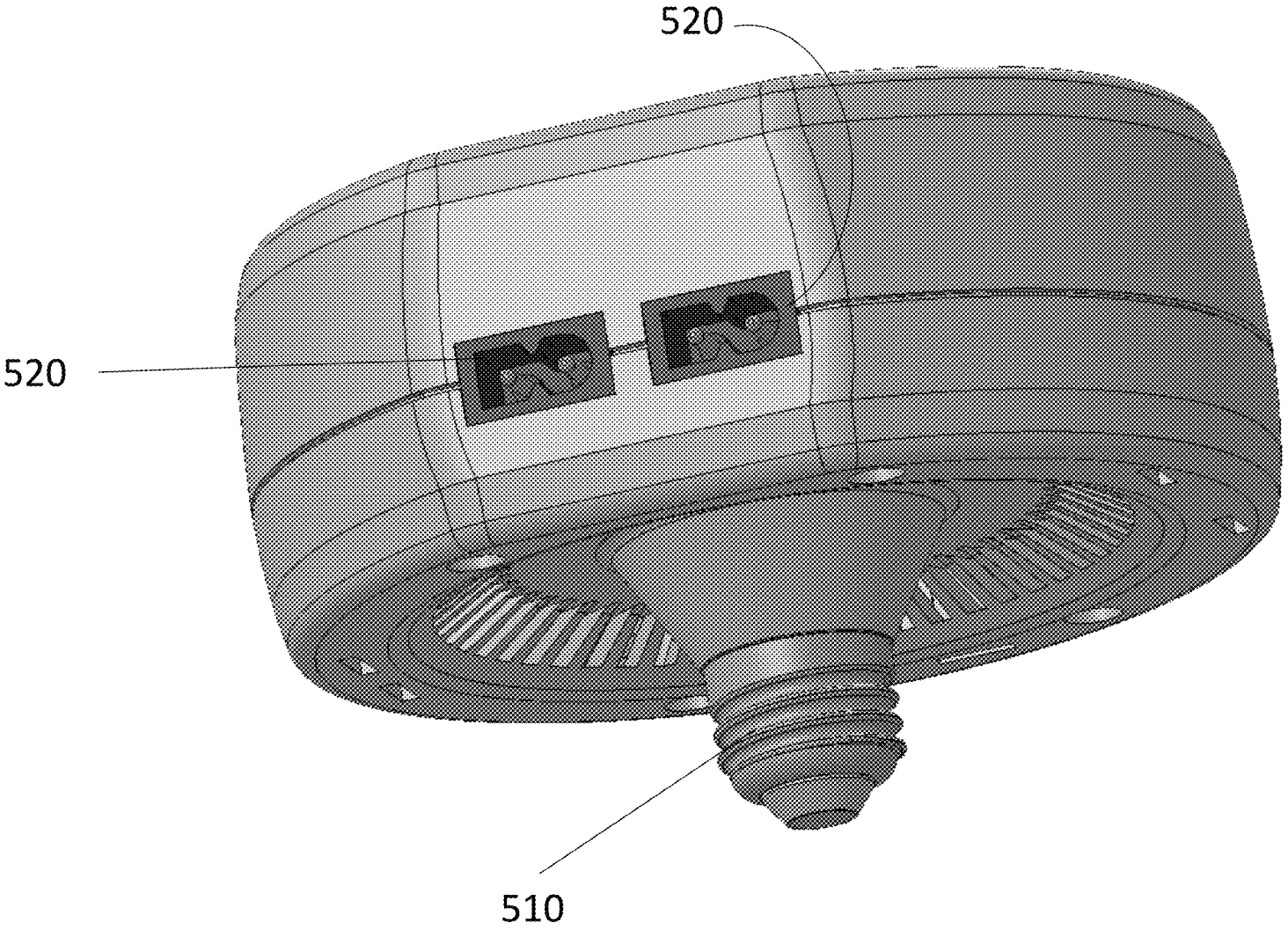
FIG. 19 is a perspective view of a light adapter for use with keyless lamp holder according to one embodiment of the present invention.

With reference to FIG. 19 and according to one embodiment of the present invention, a light adapter 500 for use with a keyless lamp holder is shown. The use of the term keyless lamp holders also includes any other type of incandescent style lamp holders as would be known by a worker skilled in the relevant art. The adapter 500 has a threaded end 510 allowing for placement of the adapter within a keyless lamp holder (not shown). A worker skilled in the relevant art would be familiar with the parameters of a threaded end allowing threaded end 510 to be inserted within a keyless lamp holder. The adapter 500 also has one or more plug-in receptacles 520 allowing power to be transferred to an LED fixture (not shown). The plug-in receptacles 520 in one embodiment consist of polarized LV (low voltage) receptacles such as IEC C8 2 pin (2.5 amps). The use of receptacles is not limited to any specific receptacle type and would encompass any receptacles as known by a worker skilled in the relevant art. The adapter 500 has a power conditioner (not shown) allowing for the conversion of AC power to the transmission of safe low voltage power to an LED fixture(s) connected through the receptacle(s). A worker skilled in the relevant art would be familiar with the parameters of a power conditioner as required to fit within the space constraints of the present adapter.

With further reference to FIG. 19, the adapter 500 has an occupancy detector (not shown) allowing for automatic activation of an LED fixture connected to the adapter 500 when an occupant is detected within a space and deactivation when the space is unoccupied for a period of time. The use of a detector is not limited to any specific detection technology. Examples of detectors/sensors which could be used in the present adapter are 1) passive infrared or 2) ultrasonic 3) microphonic 4) microwave/doppler.

Figure 20:
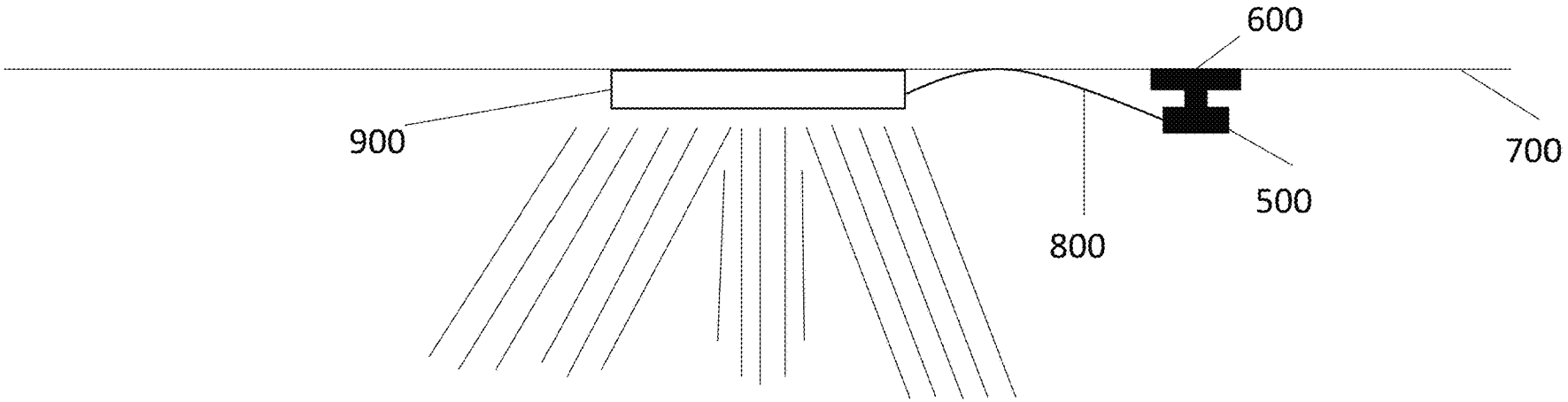
FIG. 20 is a view of the light adapter installed on a ceiling according to one embodiment of the present invention.

With reference to FIG. 20 and according to one embodiment of the present invention, the adapter 500 is installed within a keyless lamp holder 600 secured to a ceiling 700. A power source (not shown) is connected to keyless lamp holder 600 as would be present in garages/homes ceilings for example. The threaded end of adapter 500 is positioned in the keyless lamp holder 600 with a polarized power cord 800 interconnecting adapter 500 and an LED fixture 900.

The present adapter 500 allows the installation of an LED fixture 900 without the need for a certified electrician since the adapter conditions the power connected to the keyless lamp holder 600 in order to provide a safe low voltage to power the LED fixture 900 for lighting a room. The use of the light adapter of the present invention allows conversion of conventional lighting in an existing space such as a garage to LED lighting. The light adapter in conjunction with an LED light fixture and a power cord provide a cost effective and flexible LED lighting system. The use of the present system will allow simple DIY installation of a new LED lighting fixture(s). It will also be convenient for the occupant as conversion of the old lighting system to current LED lighting controlled by occupancy detection will allow for the lighting to be turned ON and OFF automatically without the need to physically actuate a switch. The power cord allows for the LED lighting system to be placed in areas that may prove more beneficial than the existing keyless lamp holder location. Further, the LED lighting system can provide higher light levels where existing levels are inadequate while also offering power savings as lights shut OFF automatically when the area is unoccupied.

Figure 21:
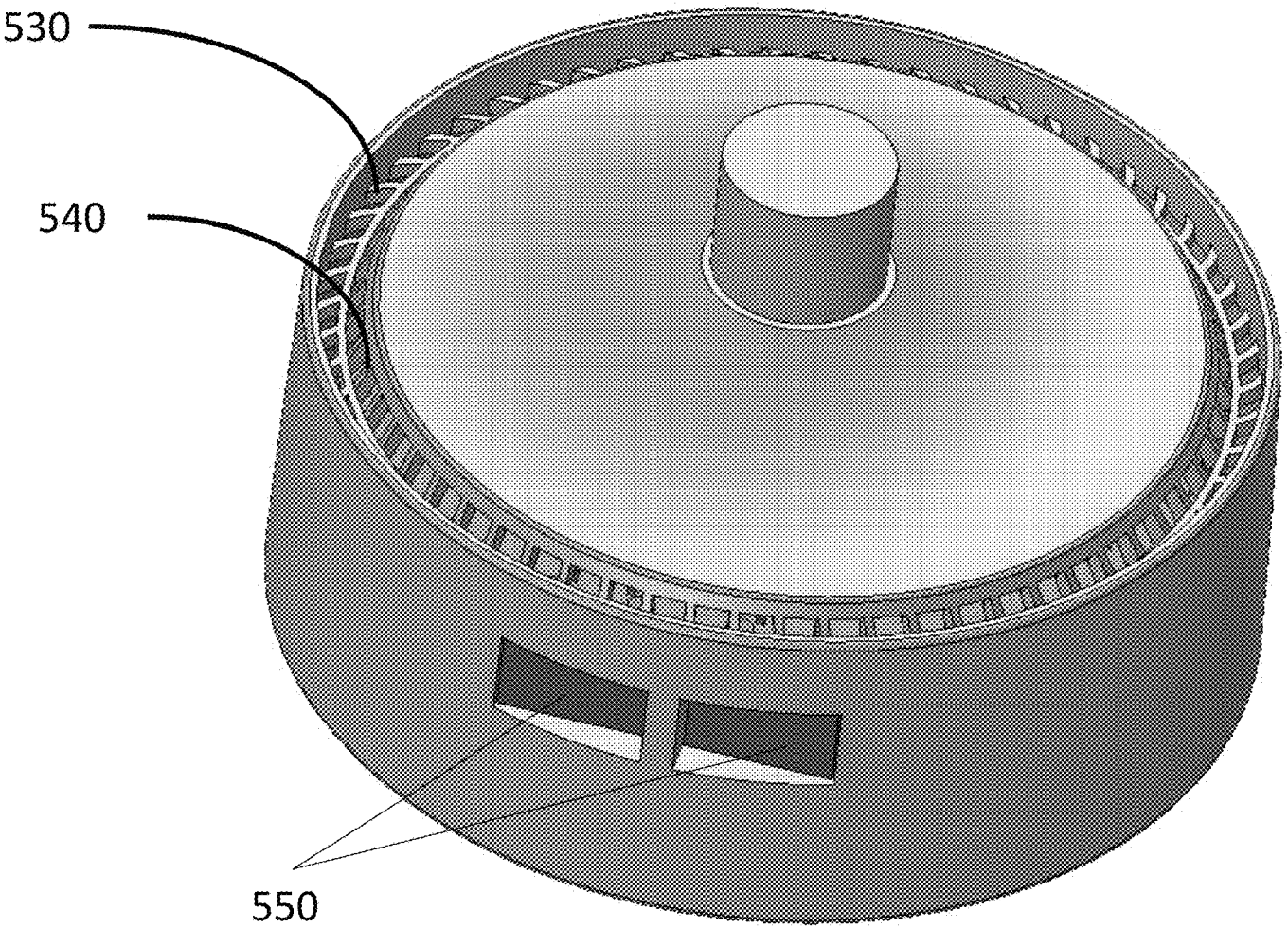
FIG. 21 is a top perspective view of a light adapter having a different housing according to another embodiment of the present invention.
Figure 22:
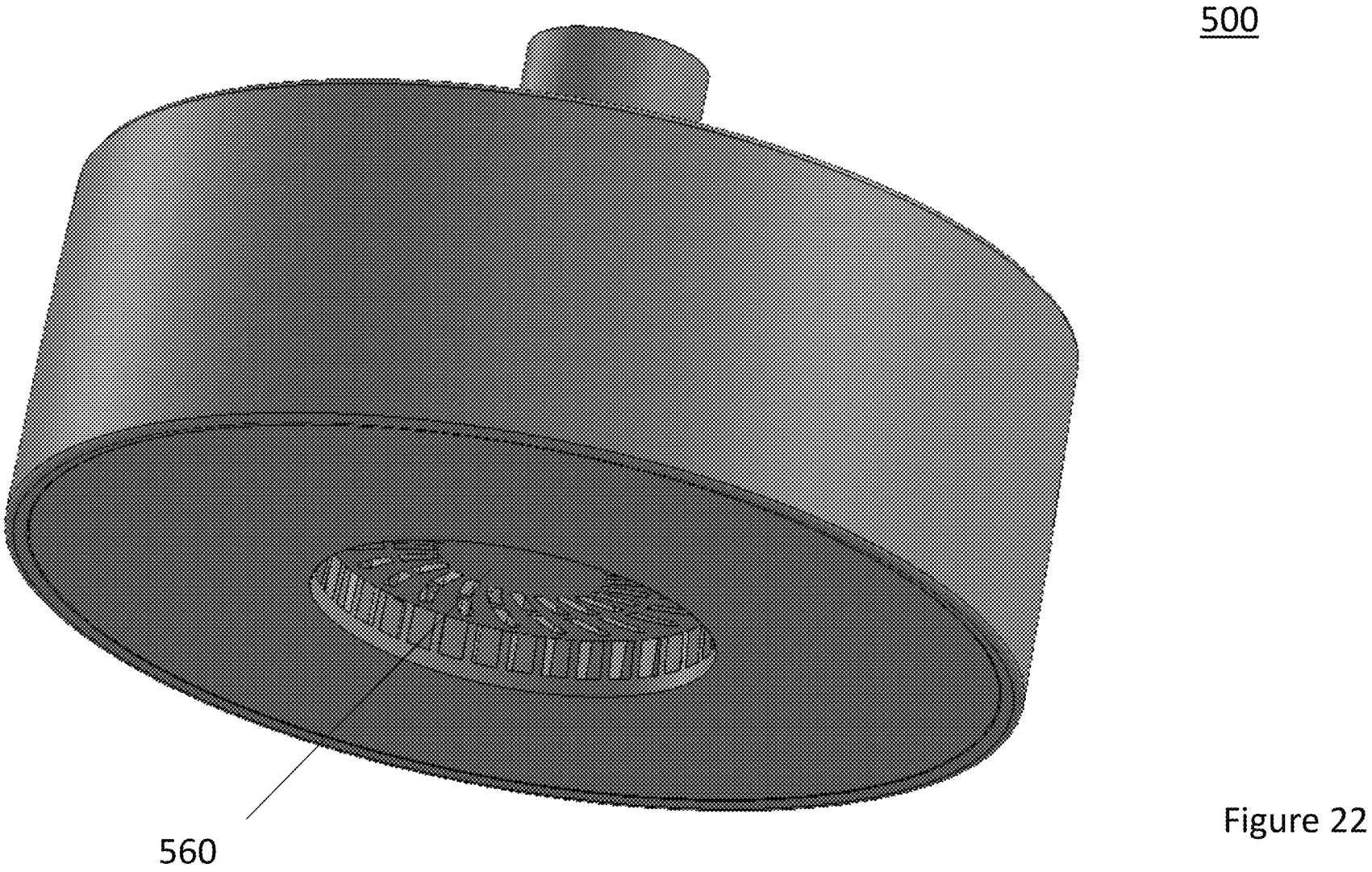
FIG. 22 is a bottom perspective view of the light adapter shown in FIG. 21 having an aperture for allowing air to enter into the light adapter according to one embodiment of the present invention.

With reference to FIGS. 21-22 and according to another embodiment of the present invention, adapter 500 has a housing which is designed to increase convective cooling. Specifically, adapter 500 as an inner flat cooling ring 530 and an inclined cooling ring 540 positioned on the top surface of adapter 500. The inner flat and inclined cooling rings 530 and 540 are on the same surface as the threaded end 510 shown in FIG. 20 however shown as unthreaded in FIG. 21. The inclusion of these perimeter cooling rings allows heat air to easily flow out of the housing which can prolong the life of the power conditioner and occupancy sensor in adapter 500. The housing of adapter 500 shown in FIG. 21 also has apertures 550 allowing for placement of plug-in receptacles as shown in FIG. 20 or any other applicable connection allowing to interconnect the adapter to the LED fixture of the present invention. With specific reference to FIG. 22, adapter 500 has an aperture 560 having a mesh configuration allowing air to enter within adapter 500 and travel across the power conditioner and occupancy detector components and out to the cooling rings 530 and 540 positioned on the opposite surface of adapter 500. The placement of the cooling rings 530 and 540 in conjunction with aperture 550 provides a more effective convective cooling of electronic components within the adapter.

Outside of replacement screw-in LED lamps which do not have occupancy detection and are limited to the existing lamp holder position, the installation of conventional LED lighting system(s) for a space currently require the need for a skilled electrician since ley less lamp holders do not offer easily accessible grounding for electrical safety. They must either be replaced with a grounded plug outlet if a grounded AC power cord is to be used or removed altogether to allow an alternative means of AC power connection. This is inconvenient and adds significant extra cost. In one embodiment of the present invention, the adapter combines a power conditioner, one or more plug-in receptacles and an occupancy sensor allowing for a quick and simple installation of an LED lighting system within a space.

A worker skilled in the relevant art would be familiar with the requirements needed for the power conditioner based on a specific application.

A worker skilled in the relevant art would also be familiar with the requirements to either add or reduce the number of plug in receptacles based on the desired number of LED lighting systems to be connected to an adapter of the present system.

In any embodiment of the present invention, the adapter can be modified to include a dip switch or other control means to adjust the activation or deactivation of the LED lighting systems along with range sensitivity. The adapter could also be modified to include other controls such as wireless dimming of the LED lights or any other applicable control method regarding the LED lighting system.

Another embodiment of the present invention would allow usage within an existing light system that offers accessible incandescent style lamp holders such as recessed down lights and surface mounted lights.

Figure 23:
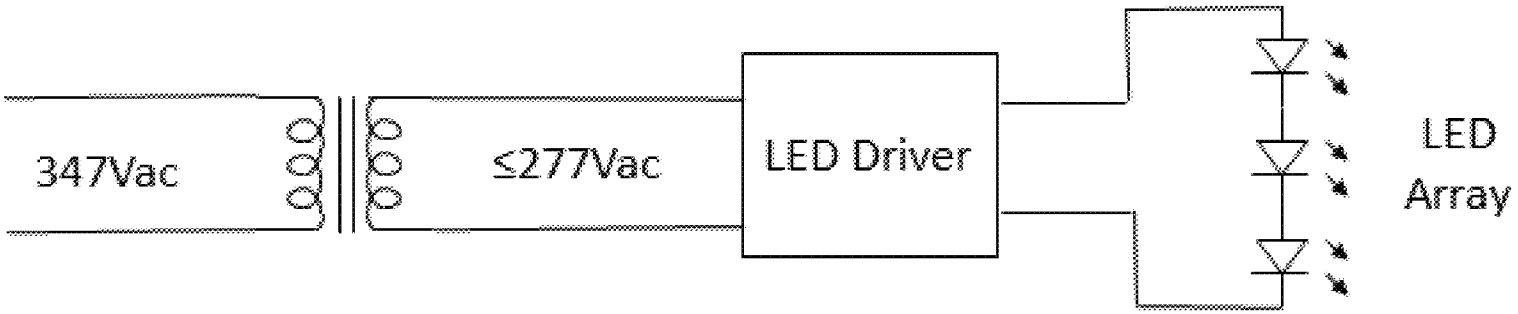
PRIOR ART Figure 23
FIG. 23 is a prior art diagram of a step-down transformer for driver circuits for light emitting diodes.
Figure 24:
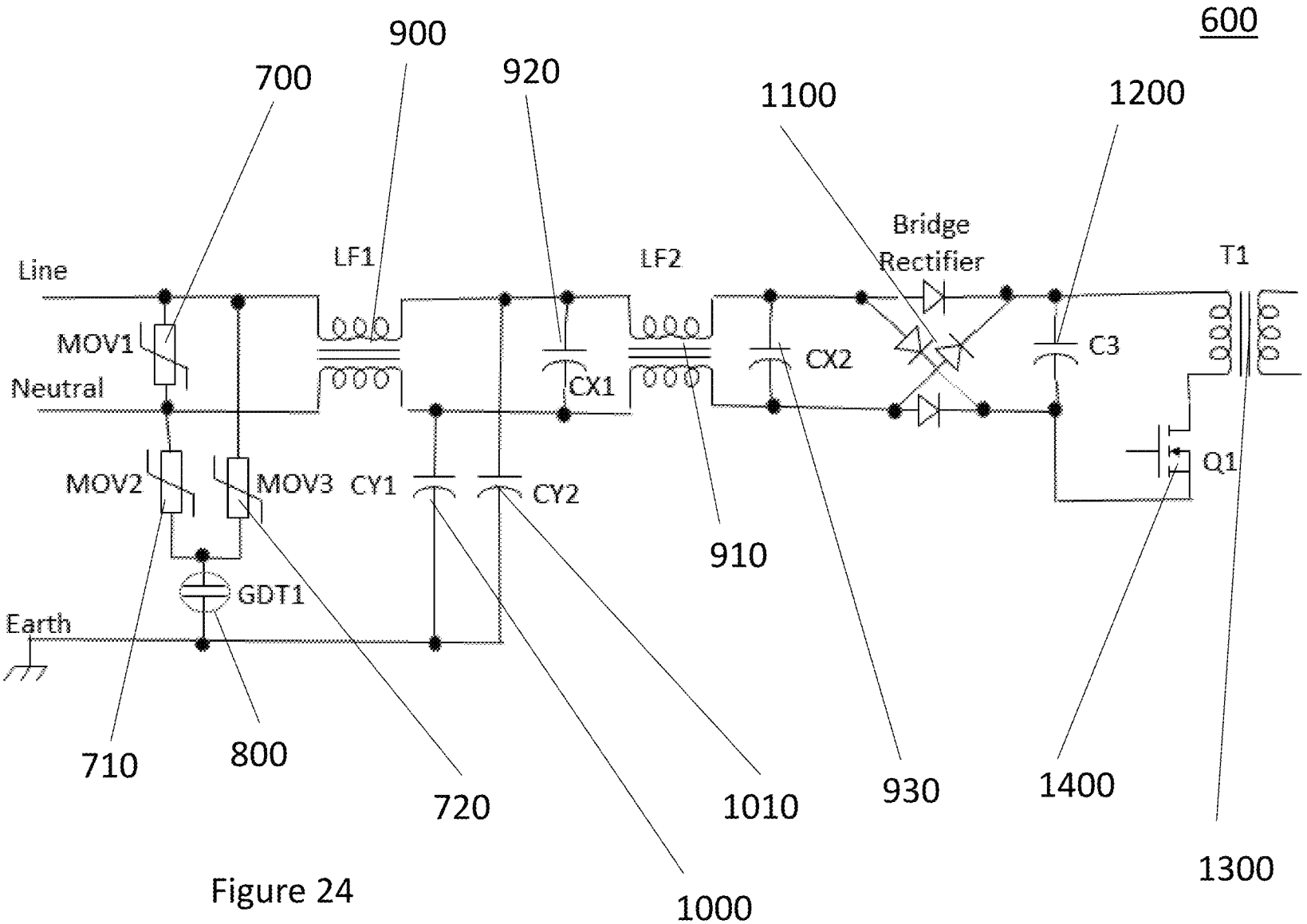
FIG. 24 is a diagram of a driver circuit for a light emitting diode according to one embodiment of the present invention.

With reference to FIG. 24 and according to an embodiment of the present disclosure, a driver circuit 600 is shown to drive a light emitting diode (LED) (not shown). The driver circuit 600 is capable of operating directly from any standard AC voltages used in Canada; from a nominal voltage of $120V_{AC}$ up to $347V_{AC}\pm10\%$ without requiring an additional step-down transformer or autotransformer. Such an additional step-down transformer is shown for illustrative purposes in FIG. 23 (Prior Art). Indeed, the step-down transformer was required to transform the power coming from the AC main, which is typically $347V_{AC}\pm10\%$ in Canada. Once the voltage is dropped, it is fed into the LED driver as shown in FIG. 22 (Prior Art). As shown in FIG. 23, such an additional step-down transformer is no longer required, as the LED driver circuit 600 is comprised of, among other features, components with a higher voltage rating in comparison to the ones used in is drivers. By removing the use of an additional step-down transformer or autotransformer, the LED (not shown) requires less complexity in production assembly, which translates into less failures, faster production, lighter product, greater safety, and less errors in the field.

With further reference to FIG. 24 and according to one embodiment of the present invention, the driver circuit 600 is comprised of a first metal-oxide varistor (MOV) 700, connected in parallel with the power source. The first MOV 700 is utilized to clamp differential surges that can occur and therefore helps protect the LED (not shown) against such surges. The driver circuit 600 is further comprised of second and third MOVs 710, 720 to clamp common-mode surges. A gas discharge tube (GDT) 800 is also present, to block leakage current coming from the second and third MOVs 710, 720 from reaching earth during normal operation, when there is no voltage surge. A worker skilled in the art would appreciate that by blocking the leakage current, the service life of the second and third MOVs 710, 720 is extended. The driver circuit 600 is further comprised of first and second common mode chokes 900, 910, designated as LF1 and LF2, respectively. First choke 900 acts in conjunction with first choke capacitor 920, while second choke 910 acts in conjunction with second choke capacitor 930, to attenuate common-mode transients. Further, the combination of first and second chokes 900, 910 along with first and second choke capacitors 920, 930, reduce the electromagnetic interference (EMI) that is generated by the switching power supply, such that less conducted emissions appear on the power line. First and second choke capacitors 920, 930 also absorb residual energy surges that make it past the first, second and third MOVs 700, 710, 720. The driver circuit 600 is also comprised of additional first and second capacitors 1000, 1010, that function to reduce conducted emissions and absorb residual energy surges that make it past the first, second and third MOVs 700, 710, 720. A bridge rectifier

1100 is also present to convert the AC power to the DC power that is required by the LED (not shown), and the bridge rectifier sends the DC voltage to charge a third capacitor 1200. A worker skilled in the art would appreciate that although a single third capacitor 1200 is shown, to receive a high-power input such as $540V_{DC}$ (rectified $382V_{AC}$) two low-voltage capacitors connected in series may also be used.

With further reference to FIG. 24 and according to one embodiment of the present invention, a transformer 1300 is shown to act as an inductive load for the switching transistor 1400, and also to provide the galvanic isolation between the AC mains and the driver circuit 10 outputs. A worker skilled in the art would appreciate that the switching transistor 1400 has a volt rating high enough to withstand the steady-state voltage across the third capacitor 1300; the transformer secondary voltage times the transformer turns ratio in the case of a fly-back power supply design; and additional margin to withstand residual voltage surges that may still appear on the third capacitor 1300.

The driver of the present invention also passed various testing as follows:

Two drivers (50 watts and 96 watts) were potted, and one un-potted and tested under two temperature extremes such as −40° C. & +40° C./high humidity; and under the following stress testing:

IEC waveform Electrical Fast Transient (Burst), class 2, 1 KV (50 W) and class 3, 2 KV (96 W), coupled to L1, L2 & PE;

Surge with IEC 1.2/50 uS combination waveform, class 3 (50 W) and class 4 (96 W), applied line-to-line and line-to-earth;

Surge 500 A IEC/ANSI 100 kHz ringwave to level 4 applied line-to-line and line-to-earth; and Power Quality Failure (dips and interrupts) with IEC voltage levels (0%, 40% & 70%) and phase angles.

The driver of the present invention passed the above testing allowing the driver to be operational even when power surges are communicated to the driver.

What is claimed is:

1. A retrofit LED system for a lighting system installed in a grid ceiling comprising:

a) an LED fixture for installation in the lighting system;

b) two support protrusions positioned on the LED fixture allowing to install the LED fixture within the lighting system; and, c) one or more lift rails for securing the LED fixture in the lighting system with the lift rail comprising:

i) one or more insertion apertures for insertion of the two support protrusions within the lift rail;

ii) one or more travel slots within the lift rail interconnected to the one or more insertion apertures allowing movement of the LED fixture within the lift rail;

iii) one or more drop slots within the lift rail interconnected to the travel slot at one end allowing to fix the LED fixture within the lighting system; and iv) one or more angled slots within the lift rail interconnected to the one or more drop slots allowing the LED fixture to be supported by the grid ceiling, the one or more angled slots having an angled upper end extending beyond the one or more drop slots to allow the two support protrusions to travel upwards and away from the one or more drop slots, thereby allowing the LED fixture to travel upwards and away from inner and outer lips of the grid ceiling such that the LED fixture clears the inner lips of the grid ceiling.

2. The LED system of claim 1 wherein the lift rail is positioned within the inner lip of the grid ceiling.

3. The LED system of claim 2, wherein the lift rail is further comprised of securement apertures to secure the lift rail to the grid ceiling.

4. The LED system of claim 1, wherein the two support protrusions are each further comprised of a male tip to guide the two support protrusions.

5. A lift rail for installing an LED fixture in a lighting system comprising:

a) one or more insertion apertures for insertion of support protrusions from the LED fixture within the lift rail;

b) one or more travel slots within the lift rail interconnected to the one or more insertion apertures allowing movement of the LED fixture within the lift rail;

c) one or more drop slots within the lift rail interconnected to the travel slot at one end allowing to fix the LED fixture within the lighting system; and d) one or more angled slots within the lift rail interconnected to the one or more drop slots allowing the LED fixture to be supported by a grid ceiling, the one or more angled slots having an angled upper end extending beyond the one or more drop slots to allow the support protrusions to travel upwards and away from the one or more drop slots, thereby allowing the LED fixture to travel upwards and away from inner and outer lips of the grid ceiling such that the LED fixture clears the inner lips of the grid ceiling.

6. The lift rail of claim 5, further positioned within the inner lip of the grid ceiling.

7. The lift rail of claim 6, further comprised of securement apertures to secure the lift rail to the grid ceiling.

* * * * *